US005302251A

United States Patent [19]

Schiel et al.

[11] Patent Number: 5,302,251

[45] Date of Patent: Apr. 12, 1994

[54] INNER SURFACE CONTOURED PRESS JACKET FOR A SHOE PRESS

[75] Inventors: Christian Schiel, Heidenheim; Harald Aufrecht, Aalen, both of Fed. Rep. of Germany

[73] Assignee: J. M. Voith GmbH, Fed. Rep. of Germany

[21] Appl. No.: 9,882

[22] Filed: Jan. 27, 1993

[30] Foreign Application Priority Data

Jan. 31, 1992 [DE] Fed. Rep. of Germany ..... 4202731

[51] Int. Cl.[5] ..... D21F 3/02

[52] U.S. Cl. ..... 162/358.4; 162/901; 428/182; 428/295

[58] Field of Search ..... 162/358.3, 358.4, 361, 162/901; 198/846, 847; 428/217, 423.3, 167, 182, 295

[56] References Cited

U.S. PATENT DOCUMENTS

| | | | |
|---|---|---|---|
| 4,287,021 | 9/1981 | Justus et al. | 162/358.3 |
| 4,482,430 | 11/1984 | Maianiemi | 162/358 |
| 4,559,258 | 12/1985 | Kiuchi | 162/358.4 |
| 4,880,501 | 11/1989 | Schiel | 162/358.4 |
| 4,978,428 | 12/1990 | Cronin et al. | 162/901 |
| 5,118,391 | 6/1992 | Matuschczyk et al. | 162/358 |
| 5,134,010 | 7/1992 | Schiel | 428/113 |
| 5,167,771 | 12/1992 | Sayers et al. | 162/901 |

*Primary Examiner*—Karen M. Hastings

*Attorney, Agent, or Firm*—Ostrolenk, Faber, Gerb & Soffen

[57] ABSTRACT

A press jacket is formed of an elastomeric jacket material having two layers of reinforcement threads, namely an inner layer and an outer layer, embedded in it. The inner layer is formed of longitudinal threads which upon operation of the press device extend parallel to the axis of rotation of the press jacket. The outer layer is formed by a fabric layer or by circumferential threads which are wound helically and which, upon operation of the press device, extend approximately in the direction of travel of the press jacket. The reinforcement threads are surrounded by the layer of elastomeric material, which is produced homogeneously. The inner surface of the press jacket has longitudinal grooves which extend parallel to the longitudinal threads and have a depth of 0.1 to 0.2 mm. Various techniques of forming those grooves are described, including enlarging the longitudinal threads, pressing on the jacket which thereby deforms around the threads, forming voids or channels in the jacket rather than having threads therein or having the press jacket material deform around the threads due to application of heat or pressure to the press jacket.

11 Claims, 2 Drawing Sheets

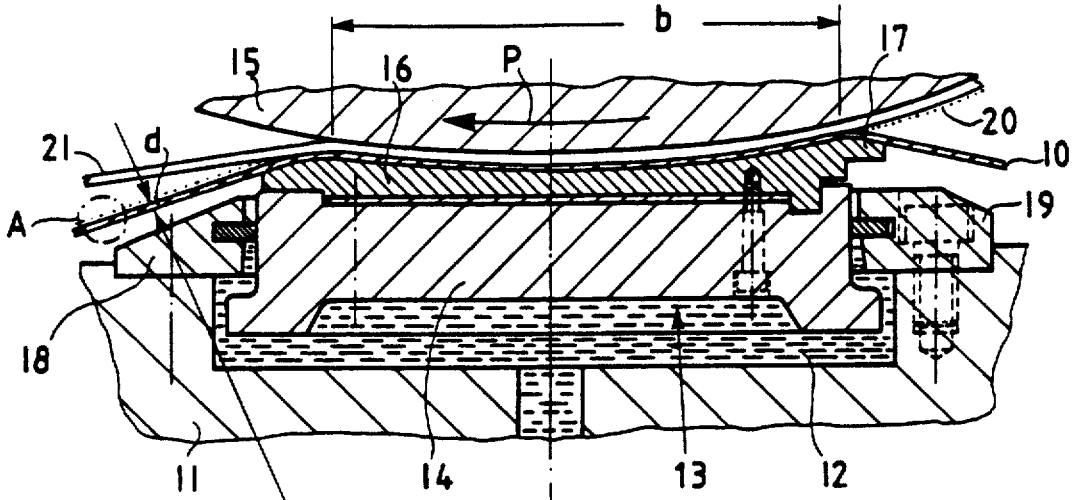
Fig. 1
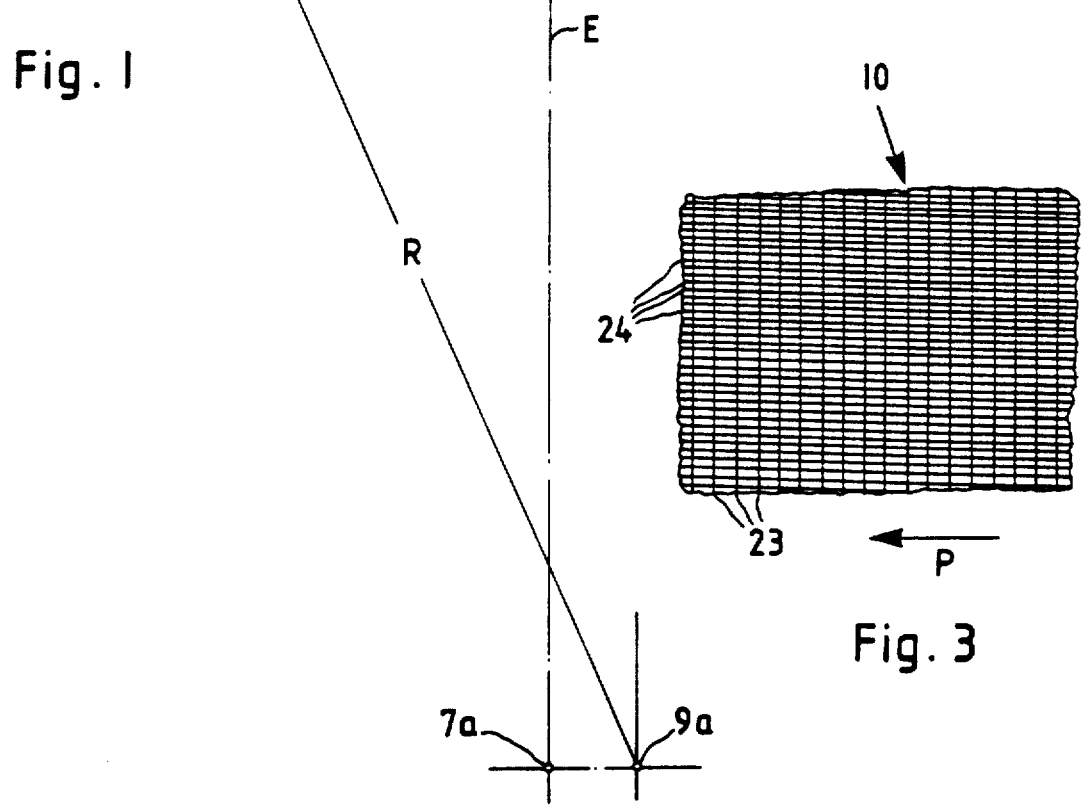
Fig. 3
Fig. 2
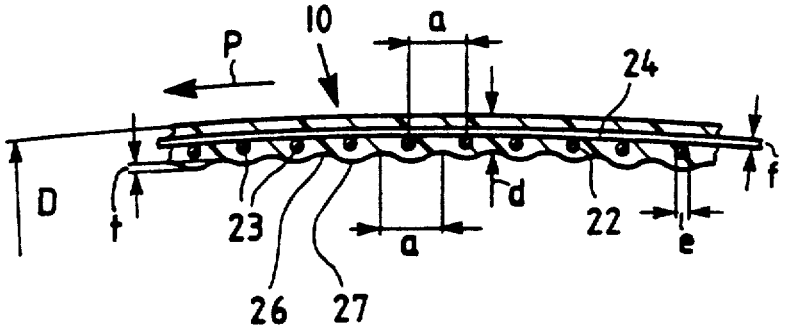

Fig. 4
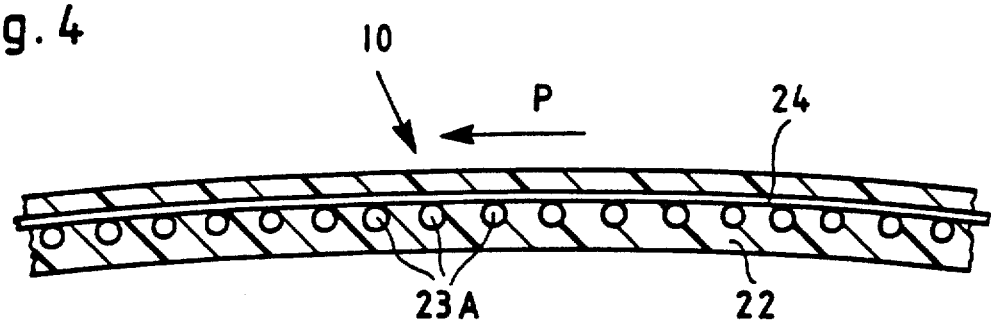
Fig. 5
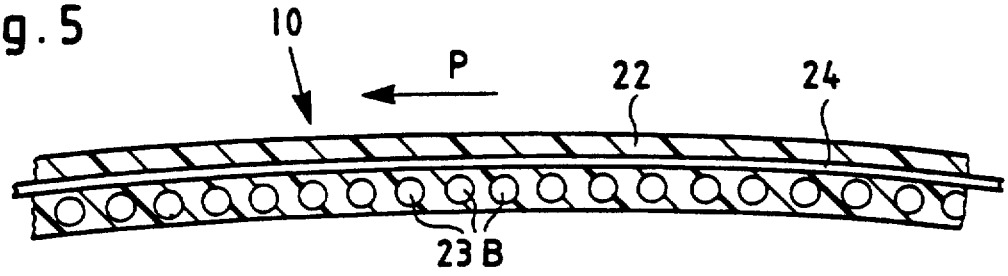
Fig. 6
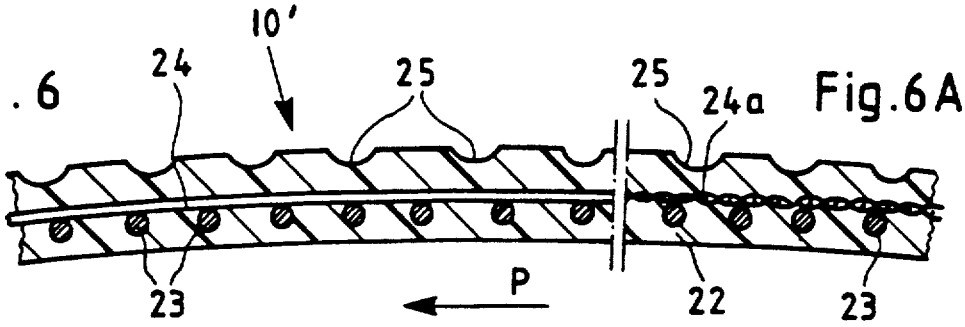
Fig. 6A
Fig. 7
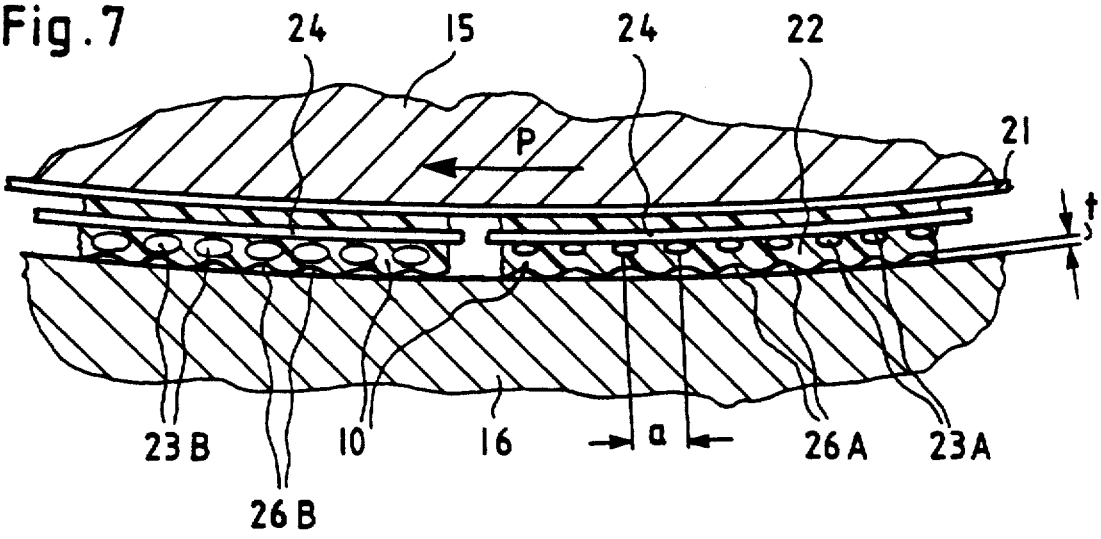

INNER SURFACE CONTOURED PRESS JACKET FOR A SHOE PRESS

BACKGROUND OF THE INVENTION

The present invention relates to the press section of a paper making machine and particularly a press jacket for a press device which has a press shoe. During operation of the press device, the press jacket rotates and slides over the press shoe. The press shoe presses the press jacket against a backing roll. The slide surface of the press shoe is usually of concave shape producing a press nip which is lengthened in the circumferential direction between the press jacket and the backing roll. The press jacket can be tubular in shape and be closed at both its lateral ends. As used below, the expression press jacket also includes an endless, laterally open press belt which also forms a lengthened press nip between a press shoe and a backing roll. Outside the press nip, the press belt travels preferably over guide rolls.

The invention proceeds from a press jacket having features which are known from German DE 40 22 800 Cl which corresponds to U.S. Pat. No. 5,118,391.

In shoe presses, frictional heat is produced in the lubricant layer, usually an oil film, that is disposed between the rotating press jacket or press belt and the stationary press shoe. This increases the temperature of the lubricant and thereby also of the press jacket. The friction generated heat is removed from the press zone along with the lubricant. The heat must be removed from the lubricant before the press jacket reenters the press zone. The smaller the amount of lubricant that is conveyed along with the press belt, the more that its temperature increases. This presents a danger and the life of the press jacket will be reduced. There are also greater temperature differences over the width of the press jacket if the thickness of the lubricant film differs.

The invention therefore concerns conveying as much lubricating oil as possible through the nip between the press jacket and the press shoe. This increases the life of the press jacket. Possible temperature differences over the width of the press jacket are reduced to a minimum.

U.S. Pat. No. 4,482,430 discloses a press belt having an inner or shoe facing surface in which recesses for the transport of the lubricant are cast or are mechanically worked. The recesses are of considerable depth, having an order of magnitude of several millimeters. The material of the belt is elastically deformable, so that the recesses and their sidewalls are flattened in operation by the action of pressure. The disadvantages of this known solution are:

a) its high cost of manufacture; b) the considerable thickness of the press belt and thus its high flexural stiffness in the circumferential direction as well as in the longitudinal direction which leads to extensive wear of the press belt, particularly upon the three dimensional curvature at the ends of the shoe; c) due to the considerable depth of the recesses, there is a danger that turbulences may be formed in the layer of lubricant, which would cause increased friction. The result is that a relatively high drive power is necessary for such a press device so that additional frictional heat is produced; d) the compressibility of the material of the belt results in a relatively low strength and a relatively low modulus of elasticity, and therefore there is relatively little resistance to elongation of the belt; and e) finally, due to the considerable depth of the recesses, there is a relatively high circumferential tension at the lowest point or bottom of each recess and cracks can result here in case of too great stressing.

The known system could theoretically operate at lower speed, namely if the press shoe were of infinite length. In practice, however, the press shoe has a finite length. The following problems arise at the end of the press shoe. With continuous deep grooves extending parallel to the belt axis, the layer of lubricant is destroyed since lubricant can flow off laterally off the belt. With pocket-like depressions, there is a danger of the bars or ridges present between the pockets being squeezed out laterally at the ends of the press shoe so that the inside of the press jacket is destroyed within a relatively short time in the regions of the ends of the press shoe.

SUMMARY OF THE INVENTION

The object of the invention is to improve the press jacket known from DE '800 while maintaining its slight thickness and its high flexural softness in the circumferential direction so that it can convey more lubricant than previously through the press nip at the lowest possible expense for manufacture. This object should be achieved also in the regions of the two ends of the press shoe without the press jacket being subjected to additional mechanical stress.

Several different ways of achieving this object are set forth in detail below. It is common to all of these solutions that, at least during operation of the press device or the shoe press, fine flat longitudinal grooves which extend transverse to the direction of travel i.e., generally along the axis of the press jacket, are present on the inner side or surface of the press jacket. This gives the inner side of the jacket a fine corrugated structure in a cross-section along the travel direction. The difference in height between each corrugation crest or ridge and the neighboring corrugation valley is dimensioned on the order of magnitude of the smallest thickness of lubricant layer to be expected, or even less. The pitch or distance from corrugation valley to corrugation valley, on the other hand, is a multiple of the smallest thickness of a lubricant layer. The average thickness of the lubricant layer is within the range of 0.01 to 0.2 mm (and rarely up to 0.25 mm), both for hydrostatically lubricated press shoes and for hydrodynamically lubricated press shoes. Accordingly, the preferred depth of the longitudinal grooves or the maximum difference in height between crest and valley is 0.01 to 0.2 mm. The preferred pitch or valley to valley distance is 1 to 5 mm. The pitch is therefore about 20 to 100 times greater than the depth of the longitudinal grooves.

The invention is distinguished from U.S. Pat. No. 4,482,430. In the invention, the depth of the longitudinal grooves is smaller by one to two powers of ten. Furthermore, the longitudinal grooves or valleys are substantially flatter. This assures that, upon the passage of the press jacket through the lengthened press zone, the layer of lubricant remains in a laminar state. This avoids the occurrence of circulation flow or turbulence in the longitudinal grooves. It also avoids the production of additional frictional heat. As a result, the life of the press jacket is increased while the necessary drive power for the press device remains at its previous relatively low level. The elastomeric material of the press jacket is substantially incompressible, in contrast to the jacket in U.S. Pat. No. '430, which contributes to this favorable result. As a result, the relatively flat longitudinal grooves are not flattened upon passage through the press zone. Accordingly, there is substantially no lateral flow of lubricant out of the longitudinal grooves in the regions toward the two ends of the press shoe. Premature wear of the press jacket in these regions is thus not expected. Another advantage of the invention is that the previously observed differences in temperature over the width of the press jacket either disappear or are at least substantially smaller than previously. This is due to the substantially larger amount of lubricant which is conducted through the press zone.

In a first group of embodiments, the finely corrugated structure of the inner side of the press jacket is present and recognizable from the start, and is present even before installation of the press jacket or press belt into the shoe press. That structure is formed therefore, directly upon or shortly after the manufacture of the press jacket.

In a second group of embodiments of the invention, the finely corrugated structure of the inner side of the press jacket is produced at some time after its manufacture, and in some cases only upon the operation of the shoe press. This finely corrugated structure is produced by one of a) swelling of the longitudinal threads by absorption of liquid; b)compressing the hollow or twisted longitudinal threads; c) compressing the "longitudinal channels" which are first produced, e.g., by forming the press jacket with longitudinal threads and then pulling out the longitudinal threads to form collapsible voids or channels; d) transferring the corrugations originally present on the outer side of the present jacket to its inner side; e) swelling the jacket material due to absorption of liquid while the reinforcing threads embedded in the jacket material do not expand; or f) an at least local thermal expansion of the material of the jacket where the threads cause expansion to produce the corrugations.

The press jacket of the invention can preferably be manufactured as previously in accordance with International publication WO 88/08897 which corresponds to U.S. Pat. No. 5,134,010 and German DE Patent 40 22 800 or U.S. Pat. No. 5,118,391. In particular, the means for clamping the longitudinal threads on a Casting cylinder as well as the pouring of the material of the press jacket and the wrapping of the circumferential threads are described in detail there. Those descriptions are incorporated by reference. The cost of manufacturing the press jacket is therefore relatively low, as previously. Furthermore, the previous small thickness and thus high flexural softness of the press jacket are retained.

Other objects, features and advantages of the present invention will be apparent from the following description of the invention which refers to the accompanying drawings.

BRIEF DESCRIPTION OF THE DRAWINGS

FIG. 1 is a partial cross section through a long-nip press device with a press jacket in accordance with the invention;

FIG. 2 is an enlarged detail A of FIG. 1 showing a part of the press jacket with a corrugated inner side;

FIG. 3 is a diagrammatic view of a part of a press jacket with the reinforcement threads present;

FIGS. 4–6 and 6A each show a part of the press jacket the inner side of which is still smooth;

FIG. 7 shows how the inner side of the press jacket of FIG. 4 or 5 can be imparted a corrugated structure during press device operation.

DETAILED DESCRIPTION OF THE PREFERRED EMBODIMENTS

Essential elements of a press device or shoe press shown in FIG. 1 are predominantly known. They include a stationary support member 11 of which only a small part is visible, a multipart press shoe 13 which is displaceable parallel to a press plane E, and a backing roll 15 toward which the shoe is displaceable. The press shoe 13 is divided into a lower part 14 and an upper part 16. The lower part 14 is a piston in a pressure chamber 12. The chamber is developed as a recess in the support member 11 and is limited by sealing strips which rest in sealing strip supports 18 and 19. The upper part 16 of the shoe has a predominantly concave upper slide surface which is mostly adapted to the shape of the backing roll 15.

A press jacket 10 slides over the shoe upper part along with the rotating backing roll. In all Figures, the direction of travel of the press jacket is indicated by an arrow P. The slide surface of the upper part 16 of the press shoe forms with the backing roll 15 a so-called lengthened press nip which has the length b in the direction of press jacket travel, indicated by an arrow P. Together with the press jacket 10, a felt belt or press wire belt 21 travels through the press nip. Furthermore, between the backing roll and the felt belt, there is a web of paper 20, which is indicated by a dotted line. If necessary, a second felt belt (not shown) is conducted through the press nip between the paper web 20 and the press jacket 10.

The arrangement shown in FIG. 1 is provided for a tubular press jacket which is closed on both ends and held in its tubular shape by jacket support disks. Such a design of a press jacket is known in the art, as in U.S. Pat. No. 5,118,391, incorporated herein by reference. Outside the press nip, the press jacket 10 travels over a substantially circular travel path having its center at 9*a* and having a radius R. The axis of rotation 9*a* of the tubular press jacket 10 is offset with respect to the center axis 7*a* of the stationary support member 11. At the entrance side of the press jacket into the press nip, the upper part 16 of the press shoe has an extension 17 which forms a rounded transition from the circular path of travel of the press belt to the concave part of the shoe slide surface. A similar rounded transition is provided at the exit side from the press nip. The press shoe 13 is pressed in the direction of the backing roll 15 by the pressure prevailing in the pressure chamber 12.

The thickness d of the press jacket 10 is approximately on an order of magnitude of 3 to 6 mm. The outside diameter of the press jacket, i.e., twice the sum of radius R plus thickness d, is, for instance, on an order of magnitude of 1.5 m. In a special case, it can also be less than 1.0 m. The jacket support disks to which the two lateral ends of the press jacket 10 are fastened and which are mounted for rotation around the axis of rotation 9*a* are not shown in FIG. 1. Instead of the jacket support disks, guide rolls can be provided at intervals around the inside of the press jacket if the press jacket is developed as an endless, laterally open press belt.

FIG. 2 shows a greatly enlarged portion of the press jacket 10 in a detail A of FIG. 1. The jacket is of elastomeric jacket material 22, for instance, polyurethane. Reinforcement threads 23 and 24 are completely embedded in the jacket material. These include the inner layer of longitudinal threads 23, which extend parallel to the axis of rotation 9a and transversely to the travel direction of the press jacket. These also include circumferential threads 24, which form the outer layer of threads and are wound over the longitudinal threads 23 which lie on the inside. The outer threads typically are wound helically. In place of the outer threads, a fabric layer of threads may be provided. The diameter f of the circumferential threads 24 is only about 1/4000 to 1/1000, and in a special case up to 1/500 of the outside diameter D of the press jacket 10. Referred to FIG. 1, $D=2(R+d)$.

FIG. 3 shows that the number of circumferential threads 24 is substantially greater per unit area, than the number of longitudinal threads 23, for example, three times greater.

In the embodiment shown in FIG. 2, the threads 23 are of a swellable material. In other words, their diameter e is both originally and during the manufacture of the press jacket smaller than as shown in FIG. 2. After production of the press jacket, its inner side can be given an after treatment in which a liquid, for instance, oil or water, is diffused through the material of the jacket and penetrates into the longitudinal threads 23. This increases the diameter e or cross-section of the threads 23 causing the inner side of the jacket to assume a corrugated contour in a cross-section through the press jacket along its travel direction. Valleys or longitudinal grooves 26 with crests 27 between them are produced. The difference in height t, i.e. the depth of the longitudinal grooves 26, is shown exaggerated in FIG. 2. That depth generally amounts to between 0.01 and 0.2 mm, and at most 0.25 mm. In FIG. 2, each of the longitudinal grooves 26 lies between two longitudinal threads 23, since the swelling of the longitudinal threads 23 forms the corrugation crests 27. The distances a between neighboring longitudinal threads 23 are of the same size as the distances between the central planes of the longitudinal grooves 26.

In all of the embodiments hereof, the grooves in the inner surface of the press jacket preferably have a depth in the range of 0.01 to 0.2 mm and at most 0.25 mm.

The after treatment with liquid described above is not necessary in all embodiments. The press jacket 10 can also be installed initially in the shoe press with its inner surface still smooth, for as in FIG. 1. The swelling of the longitudinal threads 23 and the resultant forming of the longitudinal grooves 26 then takes place during the initial phase of the operation of the press device with the aid of a liquid component of the lubricant which is fed continuously in known manner to the inner side of the press jacket 10.

In FIG. 4, instead of swellable longitudinal threads being provided, tubular longitudinal threads 23A are provided.

In FIG. 5, longitudinal channels 23B are present, which are formed by pulling out or extracting of longitudinal threads which had been present when the jacket was formed.

In FIGS. 6 and 6A, the outside of the press jacket 10' has longitudinal grooves 25 defined in it. In this case, as mentioned above, a felt belt or press wire belt is to be provided between the press jacket 10' and the web of paper. In FIG. 6A, a fabric 24a layer is provided instead of the circumferential threads 24.

In all of the above cases, the inner side of the press jacket is initially substantially smooth. But, it assumes an increasingly corrugated contour in operation under the pressure prevailing in the press nip, as seen in FIG. 7. In the press nip, the tubular or twisted longitudinal threads 23A or the tubular longitudinal channels 23B are pressed flat. In the configuration shown in FIG. 7, each longitudinal thread 23A lies in the central plane of a longitudinal groove 26A. This can also be produced in the manner that normal, non-swellable, and therefore substantially dimensionally stable, longitudinal threads and a swellable jacket material 22 or one which expands upon the application of heat are used.

Instead of compressible longitudinal threads 23A, twisted longitudinal threads can be used for instance, loose multi-filaments, whose cross-section area is reduced by the application of pressure in the pressing zone. Instead of the circumferential threads 24, a fine fabric can be provided.

The corrugated surface of the press jacket 10 is concentrated completely or predominantly on the side facing the press shoe 16 and not on the other side facing the web of paper 20.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A press jacket in a shoe press in a press section of a paper making machine, wherein the press jacket is an endless loop that moves in a travel direction and between a sliding surface of a stationary shoe and a rotating counter roll and the counter roll forms a lengthened press nip with the slide surface of the shoe, the press jacket comprising:

an elastomeric jacket material, having an inner surface which slides over the sliding surface of the press shoe and having an opposite outer surface facing outward of the sliding surface;

an inner layer of reinforcement threads in the elastomeric press jacket material, the inner layer being formed of longitudinally extending threads which extend approximately parallel to the axis about which the jacket rotates and transversely to the travel direction of the press jacket; an outer reinforcement layer, outward of the inner layer and also in the elastomeric material; the layer of reinforcement threads and the outer layer being surrounded on all sides by the layer of elastic material;

the inner surface of the press jacket having a plurality of grooves defined therein which extend generally parallel to the longitudinal threads, the grooves having a depth of at most 0.25 mm, so that the inner surface, as seen in a cross section through the press jacket along the travel direction, has a corrugated contour; and adjacent ones of said longitudinally extending threads having spacings therebetween that are generally equal to spacings between central planes of adjacent ones of said grooves.

2. The press jacket of claim 1, wherein the longitudinal grooves are placed along the travel direction of the press jacket so that respective grooves are at least in part located at the longitudinal threads.

3. The press jacket of claim 2, wherein each longitudinal thread lies generally at the center plane of a respective longitudinal groove.

4. The press jacket of claim 1, wherein the longitudinal grooves are placed along the travel direction of the press jacket so that respective grooves are at least in part located between the longitudinal threads.

5. The press jacket of claim 4, wherein each longitudinal groove lies between two adjacent longitudinal threads in the travel direction around the press belt.

6. The press jacket of claim 1, wherein the outer reinforcement layer threads comprises a fabric of reinforcement threads.

7. The press jacket of claim 1, wherein the outer reinforcement layer comprises a plurality of circumferential threads which extend approximately in the travel direction of the press jacket.

8. The press jacket of claim 7, wherein the circumferential threads are wound helically around the circumference of the press jacket.

9. The press jacket of claim 1, wherein the depth of the grooves is in the range of 0.01 to 0.2 mm.

10. The press jacket of claim 1, wherein the longitudinal grooves are spaced apart in the travel direction of the press jacket and the longitudinal threads are also spaced apart along the travel direction of the press belt a distance in the range of about 1 to 5 mm.

11. The press jacket of claim 1, wherein the layer of elastomeric material is homogeneously produced.

* * * * *